United States Patent [19]

Kuraishi et al.

[11] 4,319,165

[45] Mar. 9, 1982

[54] ELECTRONIC FLASH APPARATUS WITH FUNCTION TO BOUNCE FLASH

[76] Inventors: Kaoru Kuraishi, 4-18-19-1405, Nerima, Nerima-ku, Tokyo; Toru Goto, 1-8-9, Satsukigaoka, Chiba-shi, Chiba-ken, both of Japan

[21] Appl. No.: 948,801

[22] Filed: Oct. 5, 1978

[30] Foreign Application Priority Data

Oct. 13, 1977 [JP] Japan ..... 52-122874

[51] Int. Cl.[3] ..... H05B 41/32

[52] U.S. Cl. ..... 315/241 P; 315/151; 315/152; 315/324

[58] Field of Search ..... 315/151, 159, 241 P, 315/324, 152, 173, 231, 232, 179, 188, 189; 354/32–35, 126, 132, 145

[56] References Cited

U.S. PATENT DOCUMENTS

| | | | |
|---|---|---|---|
| 2,894,174 | 7/1959 | Schankler | 315/173 X |
| 3,113,495 | 12/1963 | Brandt et al. | 354/132 |
| 3,593,061 | 7/1971 | Takahata et al. | 315/241 P X |
| 4,068,245 | 1/1978 | Ohtaki et al. | 354/33 X |
| 4,078,240 | 3/1978 | Kaneko et al. | 354/145 X |
| 4,122,333 | 10/1978 | Crouse | 354/126 X |
| 4,242,616 | 12/1980 | Takematsu | 315/324 X |

FOREIGN PATENT DOCUMENTS

| | | | |
|---|---|---|---|
| 51-141938 | 4/1976 | Japan | 354/132 |

*Primary Examiner*—Eugene R. La Roche
*Attorney, Agent, or Firm*—Darby & Darby

[57] ABSTRACT

An electronic flash apparatus provided with a main flash apparatus having a first flash discharge tube and a sub-flash apparatus having a second flash discharge tube. The sub-flash apparatus is attached to the top of the main flash apparatus so that it may be rotated in horizontal and vertical directions.

7 Claims, 12 Drawing Figures

ELECTRONIC FLASH APPARATUS WITH FUNCTION TO BOUNCE FLASH

BACKGROUND OF THE INVENTION

This invention relates to an electronic flash apparatus provided with a plurality of flash discharge tubes to flash by means of electric charges stored in a capacitor.

In conventional electronic flash apparatuses, a single flash discharge tube is fixedly disposed so as to be directed toward a subject, when it is connected to a camera. Commercially available are electronic flash apparatuses are capable of bouncing flash. When using one such apparatus, the front of the subject facing a camera will invitably be dark, since the single discharge tube will be directed toward any other place than the subject.

SUMMARY OF THE INVENTION

The object of this invention is to provide an electronic flash apparatus which enables bouncing the flash without darkening the front of a subject.

According to one aspect of this invention, there is provided an electronic flash apparatus comprising a first flash discharge tube so arranged as to be fixedly directed toward a subject, a second flash discharge tube so arranged as to be directed toward an arbitrary direction, and circuit means for synchronously flashing the first and second flash discharge tubes.

According to another aspect of the invention, there is provided an electronic flash apparatus comprising a main body of the electronic flash apparatus having a first window portion, a first flash discharge tube disposed inside the first window portion of the main body, a sub-body of the electronic flash apparatus attached to the top of the main body so as to be able to rotate in the vertical and horizontal directions and having a second window portion, a second flash discharge tube disposed inside the second window portion of the sub-body, and circuit means for synchronously flashing the first and second flash discharge tubes.

BRIEF DESCRIPTION OF THE DRAWINGS

FIGS. 1 and 2 are front views illustrating different states of the apparatus, and FIG. 3 is a side view.

DETAILED DESCRIPTION OF THE PREFERRED EMBODIMENTS

Figure 1:
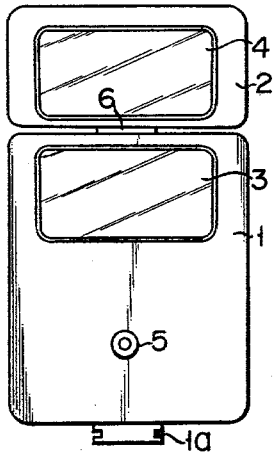
FIGS. 1 to 3 show an embodiment of an electronic flash apparatus of this invention.
Figure 2:
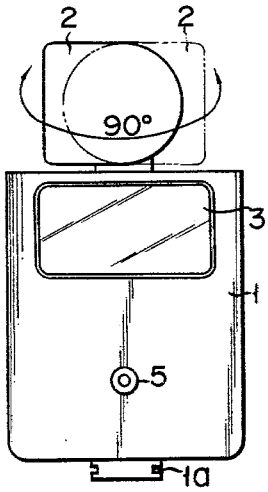

The electronic flash apparatus of this invention, as shown in FIGS. 1 and 2, is composed of a main body 1 of clip-on type electronic flash apparatus capable of being attached to the accessory shoe of a camera by means of a fitting leg 1*a* fixed to the bottom of the main body 1, and a sub-body 2 attached to the top of the main body 1 so as to be able to rotate horizontally and vertically. In front of the main body 1 is a window portion 3 with a first flash discharge tube (not shown) filled with a rare gas such as xenon and disposed at the inside thereof. Likewise, a window portion 4 with a second flash discharge tube disposed at the inside thereof is formed in front of the sub-body 2. In the main body 1 there is provided a circuit for synchronously flashing the first and second discharge tubes. In front of the main body 1 is provided a sensing portion 5 exposed to receive reflected light from a subject.

Any suitable prior art means may easily be used for a fitting means 6 for rotatably attaching the sub-body 2 to the main body 1. The angle of rotation in the horizontal and vertical directions may suitably be set at approximately 90°.

Although the first discharge tube of the main body 1 and the second discharge tube of the sub-body 2 are flashed synchronously with each other, the quantity of light from the first discharge tube is set smaller than that from the second discharge tube. The ratio of the former to the latter may preferably be nearly 1:3.

Figure 3:
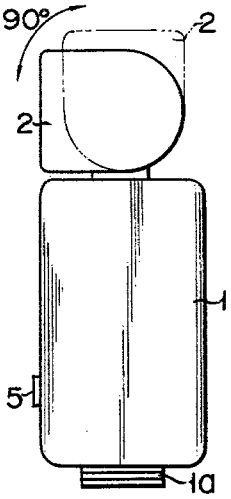

By attaching thus constructed flash apparatus to the accessory shoe of the camera, the first discharge tube is directed toward the subject, and the second discharge tube may be directed to any arbitrary direction, as shown in FIGS. 2 and 3. When the shutter release button of the camera is depressed, the first and second discharge tubes flash synchronously therewith; the flash from the second discharge tube bounces from a ceiling, for example, to light up the background of the subject, while the first discharge tube lights on the front of the subject. In the aforesaid construction, the second flash apparatus may be directed toward the subject along with the first flash apparatus, thereby enabling the ordinary stroboscopic photographing.

Figure 4:
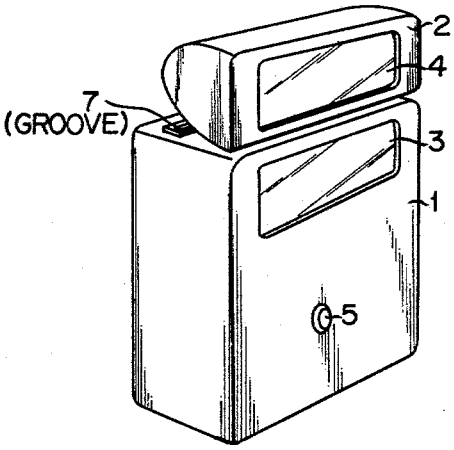
FIGS. 4 and 5 are perspective and side views of another embodiment of the invention, respectively.
Figure 5:
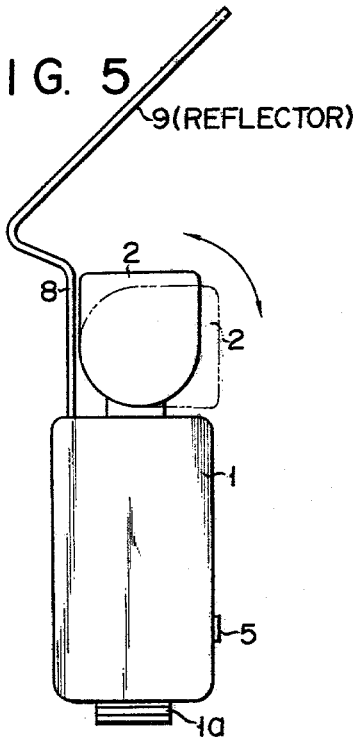

In another embodiment of this invention as shown in FIGS. 4 and 5, a groove 7 with a suitable depth is formed in the top of the main flash apparatus 1 on which the sub-flash apparatus 2 is attached, at the back of the sub-flash apparatus 2. As shown in FIG. 5, a reflector 8 with a reflecting portion 9 is inserted in the groove 7, as required. This reflector 8 has a function of diffused-reflecting a flash from the sub-flash apparatus 2 to augment the intensity of indirect light when the sub-flash apparatus 2 is directed upward.

Figure 6:
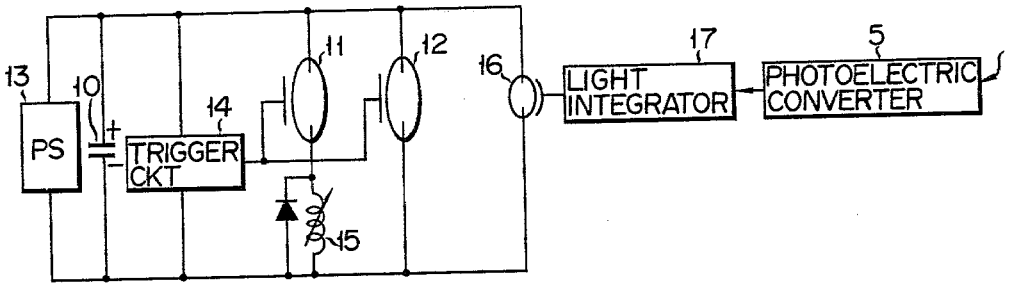
FIGS. 6 to 12 are schematic circuit diagrams which may be applied to the electronic flash apparatus of the invention.

Now there will be described the gang control of the first and second flash discharge tubes used with the flash apparatus of this invention. In the circuit of FIG. 6, a main capacitor 10, first and second discharge tubes 11 and 12, and a power source 13 are connected in parallel with one another. The first and second discharge tubes 11 and 12 are triggered by a common trigger circuit 14. As is generally known, the trigger circuit 14 includes a series circuit of a capacitor and primary winding of a transformer connected in parallel with the power source 13. Connected in parallel with the series circuit of the capacitor and primary winding is a synchro-contact which is closed in synchronism with depression of the shutter release button of the associated camera. One end of the secondary winding of the transformer is connected to trigger electrodes of the first and second discharge tubes 11 and 12, while the other end is connected to the negative terminal of the main capacitor. A variable inductor 15 is connected between the cathode of the first discharge tube 11 and the negative terminal of the main capacitor 10, thereby rendering the flash intensity level of the first discharge tube 11 lower than that of the second discharge tube 12, and suitably adjusting the ratio of the former to the latter.

A conventional by-passing discharge tube 16 is connected in parallel with the first and second discharge tubes 11 and 12. The by-passing discharge tube 16 is triggered by the output of a conventional light integrator 17, which receives an electric output from the sensing portion 5 in front of the main flash apparatus 1 to measure the reflected light from the subject. When triggered, the by-passing discharge tube 16 forms a low-impedance by-pass, thereby quenching the flash of the first and second discharge tubes 11 and 12.

Figure 7:
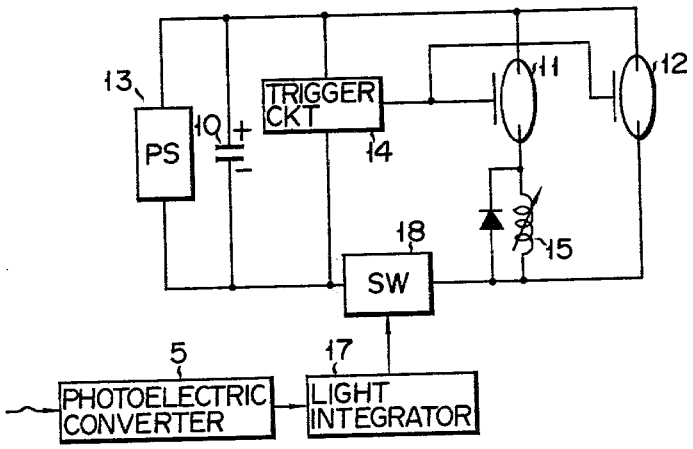

In the example of FIG. 7, a conventional switch circuit 18 is connected in series with both the first and second discharge tubes 11 and 12 across the main capacitor 10. The switch circuit 18 is opened by the output of the light integrator 17 to quench the first and second discharge tubes 11 and 12.

Figure 8:
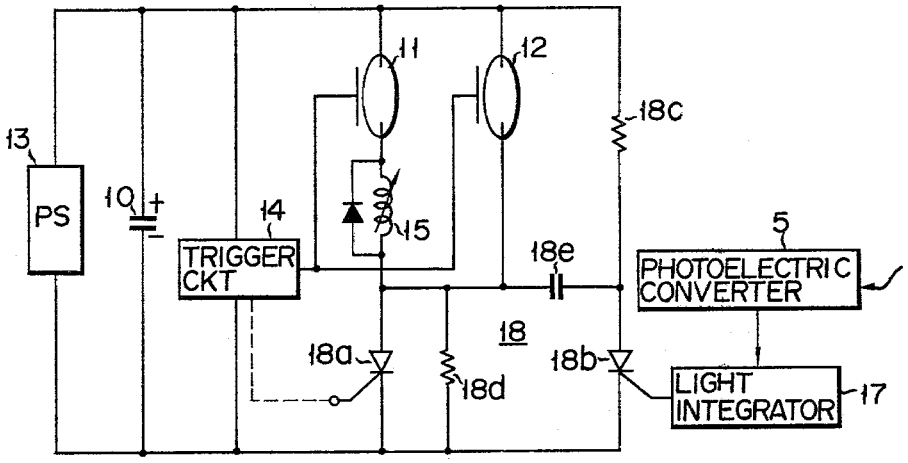

As shown in FIG. 8, the switch circuit 18 consists of a switch element or thyristor 18*a* triggered simultaneously with the flash discharge tubes 11 and 12 by the trigger circuit 14, a switch element or thyristor 18*b* triggered by the output of the light integrator 17, and a capacitor 18*e* previously charged by means of resistors 18*c* and 18*d*. The capacitor 18*e* is adapted to cause an inverse current to flow through the thyristor 18*a* to turn off the same when the thyristor 18*b* is caused to conduct by the output of the light integrator 17.

Figure 9:
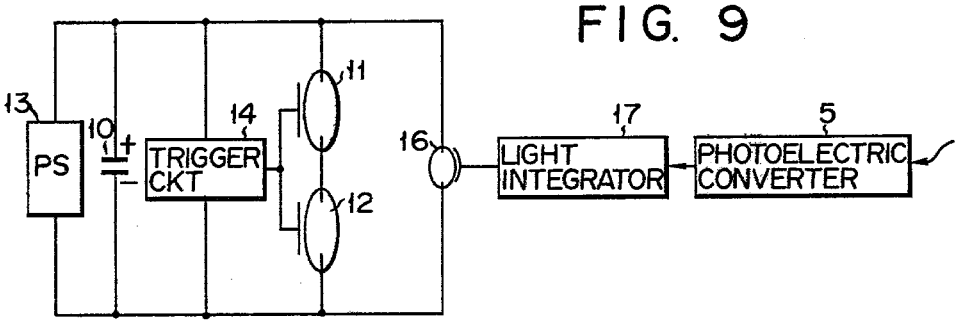

In the example of FIG. 9, the first discharge tube 11 and the second discharge tube 12 discharge across the main capacitor 10. In order to make the quantity of light from the first discharge tube 11 smaller than that from the second discharge tube 12 in this circuit, the impedance of the first discharge tube 11 in conduction must be lower than that of the second discharge tube 12. To this end, the first discharge tube 11 is made lower in gas pressure than the second discharge tube 12.

Figure 10:
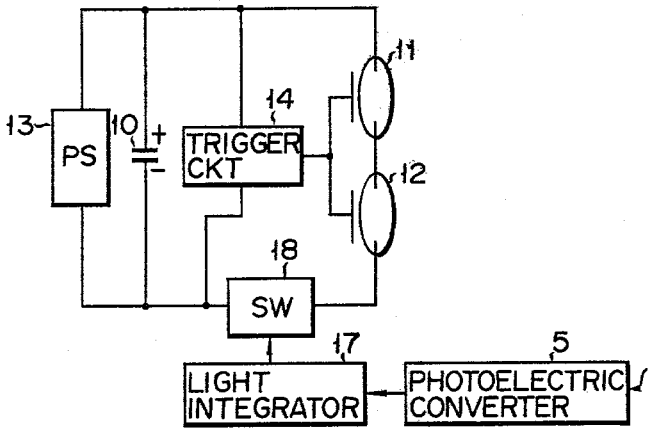

In the example of FIG. 10, the switch circuit 18 as shown in FIGS. 7 and 8 is connected in series with the first and second discharge tubes 11 and 12 connected in series with each other as shown in FIG. 9.

Figure 11:
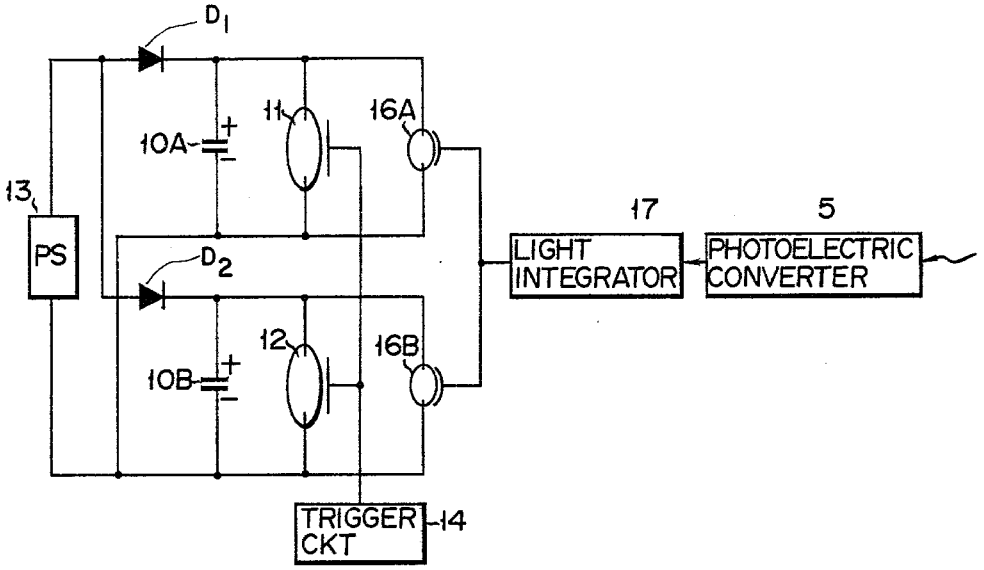
Figure 12:
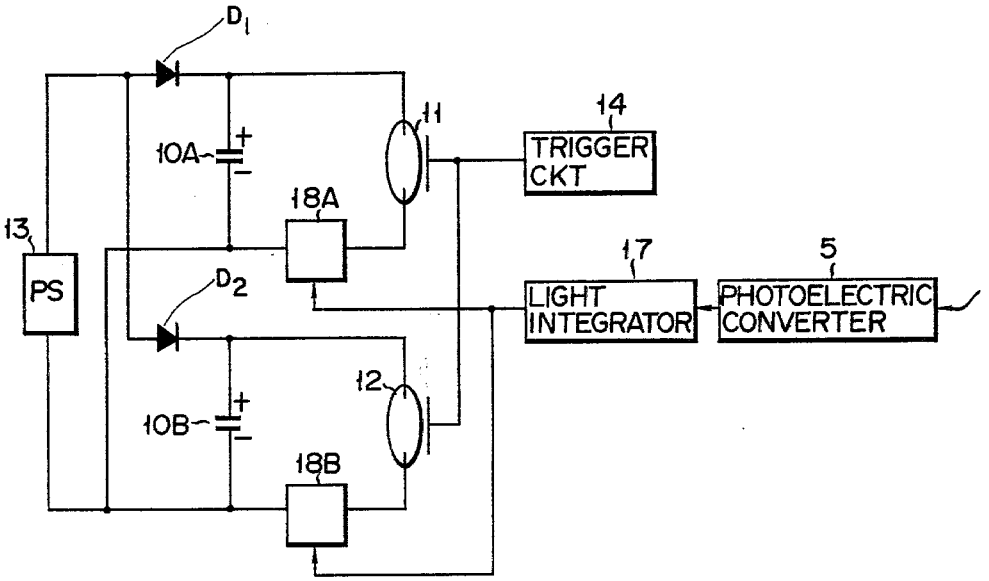

In the examples of FIGS. 11 and 12, there are first and second main capacitors 10A and 10B connected in parallel with the power source 13 through series diodes D1 and D2 respectively. The first and second discharge tubes 11 and 12 are connected in parallel with the first and second main capacitors 10A and 10B, respectively. In the circuit of FIG. 11, the first and second discharge tubes 11 and 12 are connected in parallel with first and second by-passing discharge tubes 16A and 16B, respectively. The first and second by-passing discharge tubes 16A and 16B are controlled commonly by the light integrator 17. In the circuit of FIG. 12, first and second switch circuit 18A and 18B controlled commonly by the light integrator 17 are connected in series with the first and second discharge tubes 11 and 12, respectively. In these examples of FIGS. 11 and 12, the ratio of the quantity of light emitted from the first discharge tube 11 to that from the second discharge tube 12 may be set in accordance with capacity values of the first and second main capacitors 10A and 10B. To make the quantity of light emitted from the second discharge tube larger than that emitted from the first discharge tube, the second main capacitor 10B is set larger in capacitance value than the first main capacitor 10A.

What is claimed is:

1. An electronic flash apparatus comprising: a first flash discharge tube so arranged as to be fixedly directed toward a subject, a second flash discharge tube arranged so as to be directed toward an arbitrary direction, circuit means for synchronously flashing said first and second flash discharge tubes, and circuit means for changing the ratio of the quantity of light from said first discharge tube to the quantity of light from said second discharge tube.

2. An electronic flash apparatus comprising: a main body of said electronic flash apparatus having a first window portion and a light sensing portion for sensing light reflected from an object to be photographed, a first flash discharge tube disposed inside said first window portion of said main body, a sub-body of said electronic flash apparatus fixedly attached to the top of said main body in a manner to be able to rotate in a vertical and a horizontal direction and having a second window portion, a second flash discharge tube disposed inside said second window portion of said sub-body, and circuit means for synchronously flashing said first and second flash discharge tubes, said circuit means including light integration means coupled to said light sensing means, and terminating means coupled to said light integration means and said first and second flash tubes for terminating flash of said first and second discharge tubes in response to said light integration means when the quantity of light reflected from the object reaches a predetermined value.

3. An electronic flash apparatus according to claim 2, wherein a groove to receive a reflector is formed on the top of said main body of the electronic flash apparatus at the back of said sub-body.

4. An electronic flash apparatus according to claim 2, wherein said circuit means includes a power source connected in parallel with said first and second flash discharge tubes, a main capacitor, a trigger circuit for triggering said first and second flash discharge tubes, and an impedance means connected in series with said first flash discharge tube, whereby the quantity of light from said first flash discharge tube is rendered smaller than the quantity of light from said second flash discharge tube.

5. An electronic flash apparatus according to claim 4, wherein said impedance means includes a variable inductor.

6. An electronic flash apparatus comprising: a first flash discharge tube so arranged as to be fixedly directed toward a subject, a second flash discharge tube arranged so as to be directed toward an arbitrary direction, and circuit means for synchronously flashing said first and second flash discharge tubes, said circuit means including a power source, a main capacitor connected in parallel with said power source, and a trigger circuit connected to said main capacitor for triggering said first and second flash discharge tubes, said first and second flash discharge tubes being connected in series with each other across said main capacitor, wherein said first discharge tube is made lower in gas pressure than said second discharge tube.

7. An electronic flash apparatus comprising: a first flash discharge tube so arranged as to be fixedly directed toward a subject, a second flash discharge tube arranged so as to be directed toward an arbitrary direction, and circuit means for synchronously flashing said first and second flash discharge tubes, said circuit means including a power source, first and second main capacitors connected respectively in parallel with said power source, and a trigger circuit for triggering said first and second flash discharge tubes, said first and second flash discharge tubes being connected in parallel with said first and second main capacitors respectively, wherein said second main capacitor has a capacitance value greater than said first main capacitor.

* * * * *